US006896331B2

(12) United States Patent
Kassai et al.

(10) Patent No.: US 6,896,331 B2
(45) Date of Patent: May 24, 2005

(54) SEAT STRUCTURE

(75) Inventors: Kenzou Kassai, Osaka (JP); Ichiro Onishi, Osaka (JP)

(73) Assignee: Aprica Kassai Kabushikikaisha, Osaka (JP)

( * ) Notice: Subject to any disclaimer, the term of this patent is extended or adjusted under 35 U.S.C. 154(b) by 0 days.

(21) Appl. No.: 10/382,790

(22) Filed: Mar. 5, 2003

(65) Prior Publication Data

US 2003/0168898 A1 Sep. 11, 2003

(30) Foreign Application Priority Data

Mar. 7, 2002 (JP) ..... 2002-061972

(51) Int. Cl.[7] ..... A47C 27/00; B60N 2/02

(52) U.S. Cl. ..... 297/354.13; 297/354.1; 297/229

(58) Field of Search ..... 297/354.13, 354.1, 297/352, 463.2, 182, 229; 5/617, 655

(56) References Cited

U.S. PATENT DOCUMENTS 888,303 A * 5/1908 Bowers et al. ..... 5/617
3,416,839 A * 12/1968 Flint ..... 297/396
4,793,012 A * 12/1988 LaPorte ..... 5/420
5,486,035 A * 1/1996 Koepke et al. ..... 297/320
5,490,685 A 2/1996 Kitayama et al.
5,520,435 A * 5/1996 Fujimoto et al. ..... 297/61
5,524,964 A * 6/1996 Weimersheimer ..... 297/256.12
5,660,439 A * 8/1997 Unwalla ..... 297/316
5,669,623 A 9/1997 Onishi
5,752,738 A 5/1998 Onishi et al.
5,826,940 A * 10/1998 Hodgdon ..... 297/303.1
5,842,264 A 12/1998 Roossien et al.
6,394,542 B2 * 5/2002 Potisch et al. ..... 297/182
6,488,332 B1 12/2002 Markwald
6,533,352 B1 * 3/2003 Glass et al. ..... 297/299

FOREIGN PATENT DOCUMENTS

EP 0911008 4/1999

* cited by examiner

*Primary Examiner*—Peter M. Cuomo
*Assistant Examiner*—Sarah C. Burnham
(74) *Attorney, Agent, or Firm*—W. F. Fasse; W. G. Fasse

(57) ABSTRACT

A seat structure includes a seat plate, a backrest plate adjustable in inclination angle, and a bridging member covering up a flexion portion between the seat plate and the backrest plate for bridging the seat plate and the backrest plate smoothly. The bridging member is a member shaped like a thin flat plate having a flexural elasticity and stably supports a baby's buttocks while dispersing a body pressure with its entire surface. This structure can provide such a seat structure that can prevent local loads from acting on the buttocks both in the form of a bed and in the form of a chair.

18 Claims, 4 Drawing Sheets

SEAT STRUCTURE

BACKGROUND OF THE INVENTION

1. Field of the Invention

The present invention relates to a seat structure including a seat portion and a backrest portion adjustable in inclination angle, and more particularly to a seat structure suitable for nursing equipment.

2. Description of the Background Art

In nursing equipment such as a baby carriage, a baby rack and a child seat, an inclination angle of a backrest portion of a seat is usually adjustable. In the nursing equipment receiving a baby shortly after birth, the backrest portion is inclined backward to an approximately horizontal state in order to realize a bed state. Nursing equipment that can be switched between the form of a bed and the form of a chair in accordance with the developmental stages of infants is commercially available.

FIG. 1 is a view showing a partial seat of nursing equipment in the form of a bed as seen from above. The seat includes a seat portion 1 and a backrest portion 2 adjustable in inclination angle. Seat portion 1 and backrest portion 2 are pivotably coupled to each other such that a flex angle therebetween can be adjusted. A variety of techniques for pivotably coupling these portions may be contemplated, and FIG. 1 shows an exemplary technique.

A back end portion of seat portion 1 has a protruding portion 1*a* and a notch portion 1*b* that are positioned alternately. Similarly, a front end portion (or a lower end portion) of backrest portion 2 has a protruding portion 2*a* and a notch portion 2*b* that are positioned alternately. A shaft 3 passing through protruding portion 1*a* of seat portion 1 and protruding portion 2*a* of backrest portion 2 is provided to allow seat portion 1 and backrest portion 2 to be coupled in a flexible manner.

Usually, a seat plate and a backrest plate made of a resin to form seat portion 1 and backrest portion 2 are provided with concave, groove portions 1*c*, 2*c* in places as shown.

FIG. 2 shows a baby lying down on the seat in the form of a bed, and FIG. 3 shows a baby sitting on the seat in the form of a chair. At a flexion portion formed by seat portion 1 and backrest portion 2, that is, a coupling portion therebetween, there exist protruding portions 1*a*2*a* and notch portions 1*b*, 2*b* through which shaft 3 passes. In the form of a bed shown in FIG. 2, an upper surface of seat portion 1 and an upper surface of backrest portion 2 form an approximately horizontal surface. On the other hand, protruding portions 1*a*, 2*a* through which shaft 3 passes projects slightly above the aforementioned horizontal surface, and notch portions 1*b*, 2*b* form a concave recessed below the aforementioned horizontal surface.

As shown in FIG. 2, when a baby is lying down, its buttocks are positioned on the coupling portion between seat portion 1 and backrest portion 2. Since the concave and convex formed by protruding portions 1*a*, 2*a*, notch portions 1*b*, 2*b*, and groove portions 1*c*, 2*c* are formed at this portion, a local load acts upon the baby's buttocks in contact with these concave and convex. In other words, in FIG. 2, a body pressure is concentrated on an upper end corner portion B of notch portion 1*b* and an upper surface C of protruding portion 2*a*.

A structure for coupling seat portion 1 and backrest portion 2 to each other in a flexible manner is not limited to that shown in FIG. 1 and a variety of structures may be contemplated. Any adopted structure cannot avoid the formation of concave and convex in the coupling portion between the seat portion and the backrest portion.

In the form of a chair shown in FIG. 3, seat portion 1 and backrest portion 2 are positioned to form a flexion at a prescribed angle. A corner gap 4 as shown is always formed at the back sides of the buttocks of a baby seated on this seat. As a result, a body pressure is concentrated on the baby's buttocks or loins D in contact with the upper end portion of corner gap 4. Medically, sensory nerves giving a feeling of pressure are distributed in the human structures such as the skin, muscles and blood vessels. A pain threshold of sensory nerves varies depending on the respective body region. At present, the pain threshold for a baby's buttocks has not yet been determined clearly, but it is said that the pain threshold at the abdomen is 2.2 $Kg/cm^2$. When the baby's pain sensation is stimulated by the load locally acting upon the baby's buttocks, the baby feels uncomfortable, resulting in an adverse effect on the brain.

In particular, in baby carriages or child seats, the stimulation of the sensory nerves by the local loads is considered great because vibrations involved with movements always act on the seat. Furthermore, in a case of a premature baby, even a small step at a body-supporting portion may have an adverse affect on a baby's growth. Therefore any local loads on the buttocks have to be avoided by any means.

The uncomfortable feeling because of the local loads acting on the buttocks may apply to adult's seats.

SUMMARY OF THE INVENTION

An object of the present invention is to provide a seat structure capable of dispersing a body pressure acting on the buttocks.

Another object of the present invention is to provide a seat structure capable of preventing local loads acting on the buttocks both in the form of a bed and in the form of a chair.

A further object of the present invention is to provide a seat structure with comfortableness and relieved fatigue for a baby with unstable loins and back.

A seat structure in accordance with the present invention includes a seat portion, a backrest portion adjustable in inclination angle, and a bridging member covering up a flexion portion between the seat portion and the backrest portion for bridging the seat portion and the backrest portion smoothly.

Although a concave and convex portion or a corner gap is formed at the coupling portion between the seat portion and the backrest portion, the buttocks rest on the bridging member positioned at this coupling portion whereby a body pressure is uniformly dispersed on the bridging member. In particular, in a seat structure having a backrest portion that can be inclined backward to take the form of a bed, when it is in the form of a bed, the buttocks are not in direct contact with the concave and convex portion, thereby avoiding local loads. Furthermore, when the seat takes the form of a chair, the bridging member covers the corner gap to extend smoothly and supports the buttocks tightly with its entire upper surface.

Preferably, the bridging member is a member shaped like a flat plate exerting an elastic force against a bending force. Since the bridging member is a flat-like member having a flexural elasticity, the bridging member extends flatly when the seat takes the form of a bed, while the bridging member is pressed with the buttocks to assume a curved shape to conform to the shaped of the buttocks when the seat takes the form of a chair.

Preferably, the bridging member has its one end coupled to one of the seat portion and the backrest portion and has its other end arranged to be displaceable on the other one of the seat portion and the backrest portion in accordance with an inclination operation of the backrest portion. In a preferable embodiment, the bridging member has its one end coupled to the seat portion and has its other end arranged to slide on the backrest portion. Because of such a configuration of the bridging member, the existence of the bridging member does not inhibit the inclination operation of the backrest portion. The bridging member always covers up the flexion portion between the seat portion and the backrest portion at any inclination angle of the backrest portion.

The seat structure may include a seat assembly including a seat plate and a backrest plate, and a seat mat placed over and extending on the seat plate and the backrest plate continuously. In one embodiment, the bridging member is provided on the seat assembly. In another embodiment, the bridging member is provided on the seat mat.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
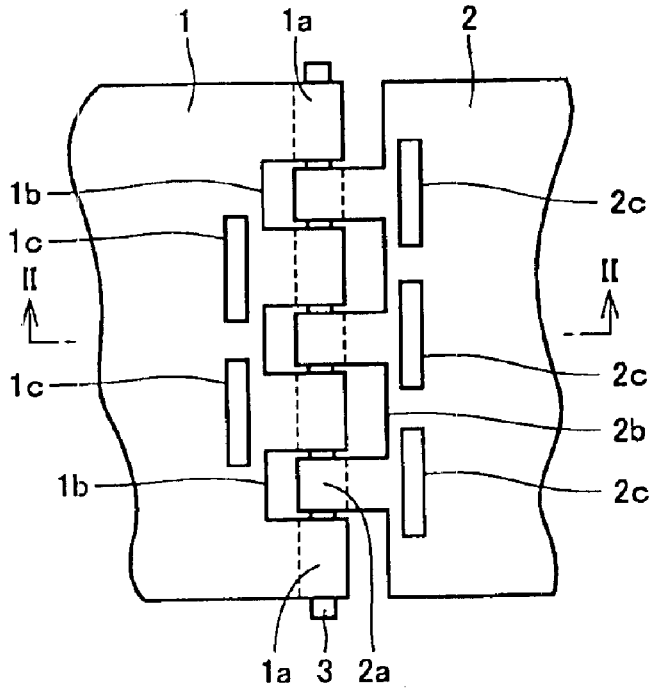
FIG.1 PRIOR ART
FIG. 1 is a planar view showing a coupling portion between a seat portion and a backrest portion.
Figure 2:
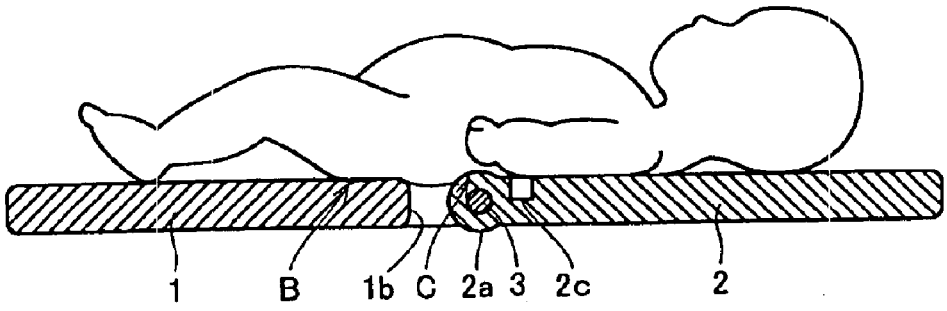
FIG.2 PRIOR ART
FIG. 2 is a view showing a baby lying on a conventional seat structure as seen along line II—II in FIG. 1.
Figure 3:
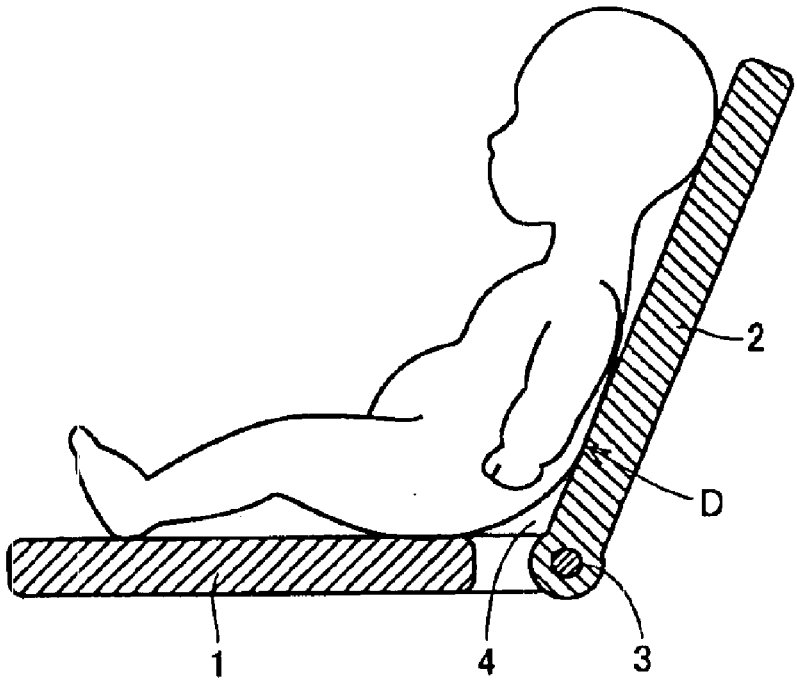
FIG.3 PRIOR ART
FIG. 3 is a view showing a baby seated on the conventional seat structure.
Figure 4:
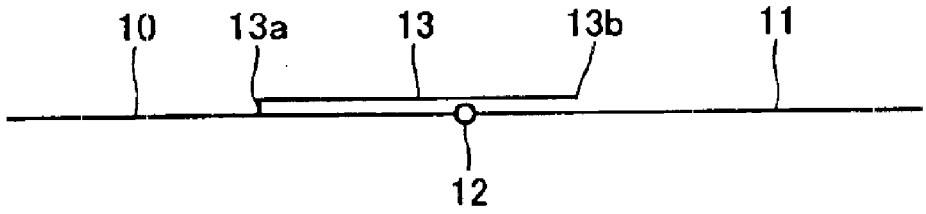
FIG. 4 is a view schematically showing an embodiment of the present invention.

FIG. 4 schematically shows a seat structure in accordance with an embodiment of the present invention. The seat structure shown is a seat assembly for nursing equipment such as baby carriages, baby racks and child seats, including a seat plate 10 formed of a rigid material and a backrest plate 11 pivotably coupled to seat plate 10 by means of a shaft 12. The seat assembly is formed such that it can be switched between the form of a chair and the form of a bed by adjusting an inclination angle of backrest plate 11. FIG. 4 shows the seat in the form of a bed.

As shown, a bridging member 13 is arranged on a flexion portion (coupling portion) between seat plate 10 and backrest plate 11. Bridging member 13 is preferably a member shaped like a thin flat plate exerting an elastic force against a bending force and has its one end 13*a* coupled to seat plate 10 by an adhesive or the like. The other end 13*b* of bridging member 13 is a free end and may slide on backrest plate 11 in accordance with the inclination operation of backrest plate 11. Polypropylene can be listed as an exemplary material forming bridging member 13.

As described above, the formation of concave and convex is inevitable at the coupling portion between seat plate 10 and backrest plate 11, as a matter of design. When the baby's buttocks directly rest on such concave and convex in the seat assembly in the form of a bed, local loads act at the concave and convex portions to give an uncomfortable feel to the baby. Bridging member 13 functions to prevent such local loads. More specifically, as bridging member 13 covers the concave and convex at the coupling portion and extends flatly, the entire upper surface of bridging member 13 supports the baby's buttocks from underneath. Therefore the body pressure is dispersed, thereby giving the baby a comfortable environment.

Figure 5:
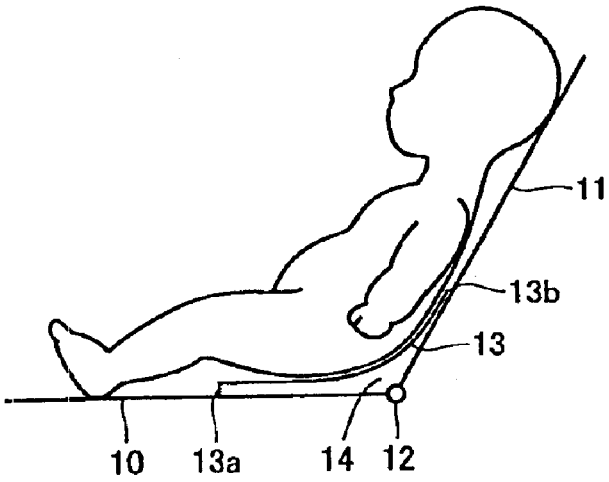
FIG. 5 is a view showing the embodiment of the present invention altered to the form of a chair.

When backrest plate 11 is lifted upward in order to switch from the form of a bed shown in FIG. 4 to the form of a chair shown in FIG. 5, the other end 13*b* of bridging member 13 slides on backrest plate 11. If the baby is not seated, bridging member 13 covers corner gap 14 between seat plate 10 and backrest plate 11 and extends flatly. When the baby is seated as shown in FIG. 5, because of the flexural elasticity of bridging member 13, bridging member 13 assumes a curved shape to conform to the baby's buttocks and supports the buttocks with its entire upper surface from underneath. Therefore, at the flexion portion between seat plate 10 and backrest plate 11, bridging member 13 can also uniformly disperse the body pressure.

While in the embodiment shown in FIGS. 4 and 5, one end 13*a* of bridging member 13 is coupled to seat plate 10 and the other end 13*b* may slide on backrest plate 11, the present invention may be configured vice versa. More specifically, the other end 13*b* of bridging member 13 may be coupled to backrest plate 11 and one end 13*a* may slide on seat plate 10. In order to realize an easy sliding operation, preferably, one end 13*a* of bridging member 13 is coupled to seat plate 10 as shown in FIGS. 4 and 5. In this manner, during the uplifting operation of backrest plate 11, as one end 13*a* acts as a fixed abutment point, the other end 13*b* slides smoothly on backrest plate 11.

Figure 6:
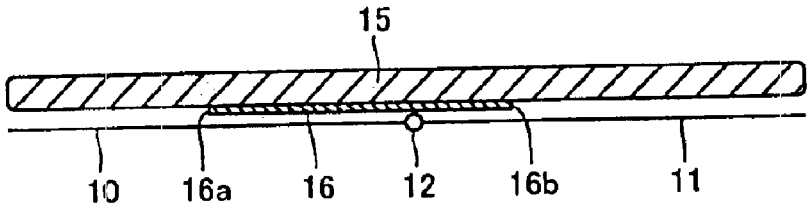
FIG. 6 is a view showing another embodiment of the present invention.
Figure 7:
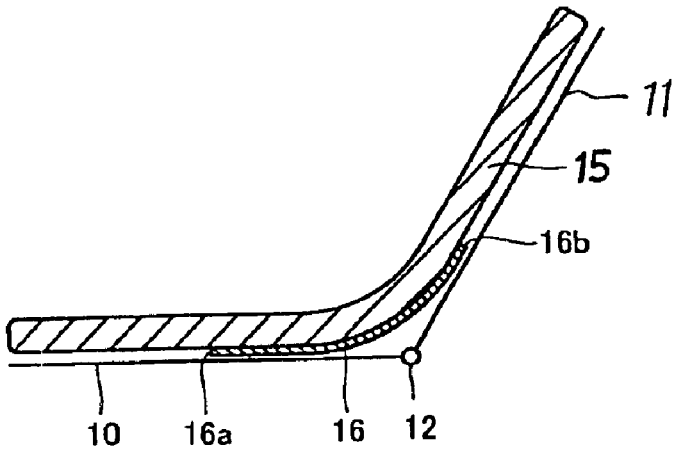
FIG. 7 is a view showing another embodiment of the present invention altered to the form of a chair.

FIGS. 6 and 7 show another embodiment of the present invention. The seat structure includes a seat assembly and a seat mat 15 arranged thereon. The seat assembly includes seat plate 10 formed of a rigid material, and backrest plate 11 pivotably coupled to seat plate 10 by means of shaft 12. Seat mat 15 is coupled to the seat assembly using appropriate means such that it is placed over and extends continuously on seat plate 10 and backrest plate 11.

A bridging member 16 is attached to the back surface of seat mat 15. One end 16*a* of bridging member 16 is coupled to the back surface of seat mat 15 using an adhesive or the like, and the other end 16*b* may slide on the back surface of seat mat 15. Bridging member 16 is arranged at a position to cover up the flexion portion (coupling portion) between seat plate 10 and backrest plate 11. The operational effect of bridging member 16 is the same as bridging member 13 in the embodiment described above and therefore the description thereof will not be repeated.

Figure 8:
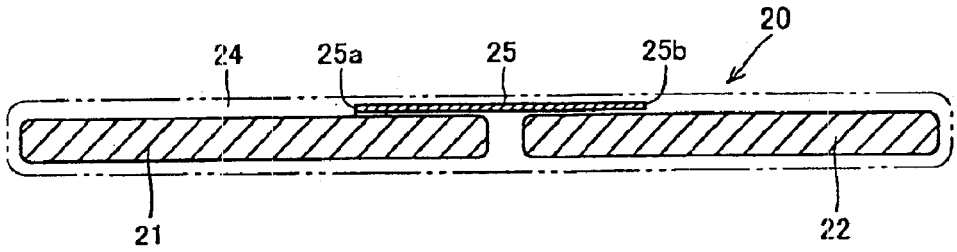
FIG. 8 is a view showing a further embodiment of the present invention.

FIG. 8 shows another example of the seat mat mounted on the seat assembly. A seat mat 20 as shown is also referred to as a seat hammock and includes a seat core member 21 made of a resin, positioned on the seat plate, a backrest core member 22 made of a resin, positioned on the backrest plate, and a cloth cover 24 wrapping these members.

As shown, on the upper surfaces of core members 21 and 22, a bridging member 25 is attached. One end 25*a* of bridging member 25 is coupled to the upper surface of seat core member 21 using an adhesive or the like, and the other end 25*b* may slide on the upper surface of backrest core member 22. The operational effect of bridging member 25 is the same as that in the embodiment described above and therefore the description thereof will not be repeated.

Figure 9:
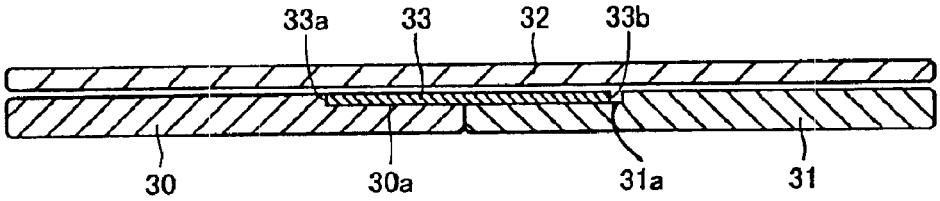
FIG. 9 is a view showing yet another embodiment of the present invention.
Figure 10:
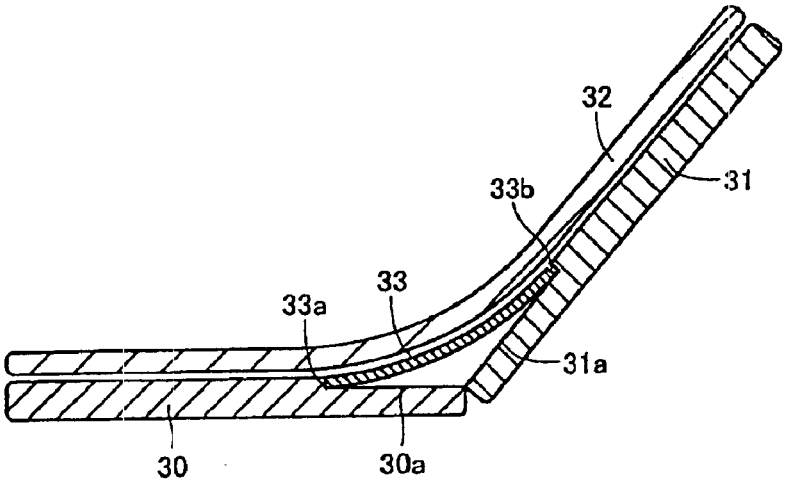
FIG. 10 is a view showing yet another embodiment of the present invention altered to the form of a chair.

FIGS. 9 and 10 show a further embodiment of the present invention. The seat includes a seat assembly formed of a seat plate 30 and a backrest plate 31, a seat mat 32 mounted on the seat assembly, and a bridging member 33. Step portions 30*a* and 31*a* having a shallow depth are formed at the back end portion of seat plate 30 and the front end portion of backrest plate 31. Bridging member 33 shaped like a thin flat plate is arranged within these step portions 30*a* and 31*a*.

Bridging member 33 is positioned to cover up the coupling portion between seat plate 30 and backrest plate 31. As shown, the length of bridging member 33 in the forward and backward direction (the length in the lateral direction in FIG. 9) is made smaller than the length of step portions 30*a* and 31*a* in the forward and backward direction (the length in the lateral direction in FIG. 9). Opposite ends 33*a* and 33*b* of bridging member 33 are not coupled to anything. Therefore, in accordance with the uplifting operation of backrest plate 31 bridging member 33 slides on step portions 30*a* and 31*a* in a relative manner. Specifically, while one end 33*a* of bridging member 33 acts as a fixed abutment point, the other end 33*b* slides on step portion 31*a* of backrest plate 31. The operational effect of bridging member 33 is the same as that in the embodiment described above and therefore the description thereof will not be repeated.

As the other embodiment, the opposite ends of the bridging member may be coupled to the seat portion and the backrest portion. In this case, the bridging member should be formed of a stretchable material. The length of the bridging member in the case of the seat structure in the form of a bed is longer than in the form of a chair.

Although the present invention advantageously applies to nursing equipment, in particular, it may apply to a seat for adults in the sense that the local loads on the buttocks can be avoided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A seat structure comprising:

a seat portion;

a backrest portion adjustable in inclination angle; and a bridging member covering up a flexion portion between said seat portion and said backrest portion for bridging said seat portion and said backrest portion smoothly on a top side of said seat portion and said backrest portion;

wherein said backrest portion can be selectively inclined so that said seat structure has a form of a chair, and selectively reclined so that said seat structure has a form of a bed, respectively by adjusting an inclination angle of said backrest portion;

wherein said flexion portion comprises a pivotable hinge joint that hingedly interconnects said seat portion and said backrest portion, wherein said hinge joint includes a convex protrusion that protrudes upwardly above said top side of at least one of said seat portion and said backrest portion, and wherein said bridging member is flexible and smoothly covers said convex protrusion.

2. The seat structure according to claim 1, wherein said bridging member is a member shaped like a flat plate exerting an elastic force against a bending force.

3. The seat structure according to claim 1, wherein said bridging member has its one end coupled to one of said seat portion and said backrest portion and has the other end that may be displaced on the other one of said seat portion and said backrest portion in accordance with an inclination operation of said backrest portion.

4. The seat structure according to claim 3, wherein said bridging member has its one end coupled to said seat portion and has the other end that may slide on said backrest portion.

5. The seat structure according to claim 1, wherein the seat structure includes a seat assembly including a seat plate and a backrest plate, and a seat mat placed over and extending continuously on said seat plate and said backrest plate, and said bridging member is provided on said seat assembly.

6. The seat structure according to claim 1, wherein the seat structure includes a seat assembly including a seat plate and a backrest plate, and a seat mat placed over and extending continuously on said seat plate and said backrest plate, and said bridging member is provided on said seat mat.

7. The seat structure according to claim 1, wherein the seat structure is a seat for nursing equipment that can be switched between a chair state in which the seat structure has said form of said chair and a bed state in which the seat structure has said form of said bed.

8. The seat structure according to claim 1, wherein said form of said bed includes said seat portion and said backrest portion aligned with each other on a flat plane.

9. The seat structure according to claim 8, wherein said flat plane is a horizontal flat plane.

10. A seat structure comprising:

a seat bottom;

a backrest that is movably joined to said seat bottom by a moveable junction, such that said backrest has an adjustable inclination angle relative to said seat bottom; and a flexible bridging member comprising a flexible plate arranged on and respectively overlapping only a portion of respective top sides of said seat bottom and said backrest without extending over a full length of said respective top sides away from said movable junction, so as to cover said movable junction and to form a smooth transition without a bend angle, without an open gap and without a convex upward protrusion between said top sides of said seat bottom and said backrest, and wherein maid flexible plate is in direct contact with or directly connected to said respective top sides of said seat bottom and said backrest;

wherein said movable junction comprises a pivotable hinge joint that hingedly interconnects said seat bottom and said backrest, wherein said hinge joint includes a convex protrusion that protrudes upwardly above said top side of at least one of said seat bottom and said backrest, and wherein said flexible bridging member smoothly covers said convex protrusion.

11. The seat structure according to claim 10, wherein said flexible bridging member is positioned and adapted to support the buttocks of a person seated on said seat structure with maid smooth transition without a bend angle, without an open gap and without a convex upward protrusion.

12. The seat structure according to claim 10, wherein said seat structure can be selectively configured into a chair configuration in which said backrest extends upwardly from said seat bottom with an obtuse angle formed therebetween, and a bed configuration in which said backrest extends approximately along a flat plane in common with said seat bottom.

13. The seat structure according to claim 10, wherein said flexible plate of said flexible bridging member is a one-piece flexible plate that is flat when unstressed and smoothly curved when flexed.

14. The seat structure according to claim 10, wherein said flexible plate is a plate consisting of a plastic layer.

15. A seat structure comprising:

a seat bottom;

a backrest that is movably joined to said seat bottom by a moveable junction, such that said backrest has an adjustable inclination angle relative to said seat bottom; and a flexible bridging member comprising a flexible plate arranged on and respectively overlapping only a portion of respective top sides of paid seat bottom and said backrest without extending over a full length of said respective top sides away from said movable junction, so as to cover said movable junction and to form a smooth transition without a bend angle, without an open gap and without a convex upward protrusion between said top sides of said seat bottom and said backrest, and wherein said flexible plate is in direct contact with or directly connected to said respective too sides of said seat bottom and said backrest;

wherein said flexible bridging member is positioned and adapted to support the buttocks of a person seated on said seat structure with said smooth transition without a bend angle, without an open ago and without a convex upward protrusion;

wherein said seat structure can be configured into a chair configuration in which said backrest extends upward from said seat bottom with an obtuse angle formed between said top sides of said seat bottom and said backrest being spanned by said flexible bridging member; and wherein said flexible bridging member has such an elastic flexibility and is arranged so that said flexible bridging member has a flat planar shape spanning between said top sides of said seat bottom and said backrest when said seat structure is in said chair configuration without the person seated on said seat structure, and said flexible is bridging member is flexed into a concave curved shape when the person is seated on said seat structure in said chair configuration.

16. A seat structure comprising:

a seat portion;

a backrest portion adjustable in inclination angle; and a bridging member covering up a flexion portion between said seat portion and said backrest portion for bridging said seat portion and said backrest portion smoothly on a top side of said seat portion and said backrest portion;

wherein said backrest portion can be selectively inclined so that said seat structure has a form of a chair, and selectively reclined so that said seat structure has a form of a bed, respectively by adjusting an inclination angle of said backrest portion;

wherein said bridging member is flexible and is positioned and adapted to support the buttocks of a person seated on said seat structure and to form a smooth transition without a bend angle, without an open gap and without a convex upward protrusion between said seat portion and said backrest portion;

wherein, in said form of said chair, said backrest portion extends upward from said seat portion with an obtuse angle formed between said top sides of said seat portion and said backrest portion being spanned by said bridging member; and wherein said bridging member has such an elastic flexibility and is arranged so that said bridging member has a flat planar shape spanning between said top aides of said seat portion and said backrest portion when said seat structure is in said form of said chair without a person seated on said seat structure, and said bridging member is flexed into a concave curved shape when the person is seated on said seat structure in said form of said chair.

17. The seat structure according to claim 16, wherein said flexion portion comprises a bendable joint by which said seat portion and said backrest portion are relatively movably connected to each other, and wherein said bridging member extends above said bendable joint so as to cover said bendable joint from above.

18. The seat structure according to claim 17, wherein said bendable joint comprises a pivot or hinge joint defining a pivot axis located below said bridging member, wherein said pivot or hinge joint pivotably connects said seat portion and said backrest portion to each other so as to be pivotable relative to each other about said pivot axis.

* * * * *

UNITED STATES PATENT AND TRADEMARK OFFICE

CERTIFICATE OF CORRECTION

PATENT NO. : 6,896,331 B2
DATED : May 24, 2005
INVENTOR(S) : Kenzou Kassai et al.

It is certified that error appears in the above-identified patent and that said Letters Patent is hereby corrected as shown below:

Column 1,
Line 45, after "portions" replace "1a2a" with -- 1a, 2a --.

Column 2,
Line 10, after "corner gap 4." begin a new paragraph with -- Medically, … --.
Line 62, after "is a" replace "flat-like" with -- flat plate-like --.

Column 6,
Line 55, before "flexible plate" replace "maid" with -- said --.

Column 7,
Line 1, after "with" replace "maid" with -- said --.
Line 24, after "top sides of" replace "paid" with -- said --.
Line 32, after "respective" replace "too" with -- top --.
Line 37, after "an open" replace "ago" with -- gap --.

Column 8,
Line 1, after "flexible" delete "is".
Line 31, after "said top" replace "aides" with -- sides --.

Signed and Sealed this

Twenty-third Day of August, 2005

JON W. DUDAS
*Director of the United States Patent and Trademark Office*